United States Patent [19]

Prescott

[11] Patent Number: 4,995,757

[45] Date of Patent: Feb. 26, 1991

[54] MANHOLE COVER ANNULAR SUPPORT FOR REPAVED STREET

[76] Inventor: Alain Prescott, 102 De Gaulle Street, Ville de Lorraine, Canada, J6Z 3Z2

[21] Appl. No.: 502,685

[22] Filed: Apr. 2, 1990

[51] Int. Cl.[5] ..... E02D 29/14

[52] U.S. Cl. ..... 404/26; 404/25; 49/465

[58] Field of Search ..... 404/25, 26, 37–41, 404/85, 134–136; 49/463–466

[56] References Cited

U.S. PATENT DOCUMENTS

| | | | |
|---|---|---|---|
| 3,891,337 | 6/1975 | McCoy | 404/26 |
| 4,188,151 | 2/1980 | Hall | 404/26 |
| 4,337,005 | 6/1982 | LeBaron | 404/26 |
| 4,690,584 | 9/1987 | Lebaron | 404/26 |
| 4,925,337 | 5/1990 | Spiess et al. | 49/463 |

FOREIGN PATENT DOCUMENTS

| | | | |
|---|---|---|---|
| 141824 | 10/1930 | Fed. Rep. of Germany | 404/26 |
| 3305172 | 8/1984 | Fed. Rep. of Germany | 404/25 |
| 132217 | 7/1951 | Sweden | 49/463 |

*Primary Examiner*—Ramon S. Britts
*Assistant Examiner*—Roger J. Schoeppel
*Attorney, Agent, or Firm*—Robic

[57] ABSTRACT

In a street manhole defining an elongated manhole duct provided with a rigid collar at its top mouth, the collar having a radially inward annular cavity defining a base wall, parallel to the plane of the collar and a side wall, orthogonal to the base wall. The collar further defines a top wall parallel to the base wall. A spacer device is provided for raising the cover level from the collar base wall, and defines: (a) a first rigid ring, destined to sit on the collar base wall; (b) a second rigid ring, diametrally larger than the first ring and destined to sit on the collar top wall; and (c) connecting tongues, for coaxially interconnecting the rings about spaced planes, the connecting tongues being flexible and capable of bending under load, so as to bring the first ring to sit against the collar base wall and the second ring to sit against the collar top wall. The tongues will bend longitudinally so as to pivot about their lengthwise axes upon being responsive to a biasing load being applied transversely to the plane of at least one of the cover member and the second ring.

9 Claims, 3 Drawing Sheets

MANHOLE COVER ANNULAR SUPPORT FOR REPAVED STREET

FIELD OF THE INVENTION

The invention relates to an annular support for raisin the circular cover of a street manhole from its original supporting collar, when it is desired to cover the street with an additional layer of pavement.

In the present specification and in the appended claims, the term manhole is intended to designate all kinds of manholes, including gully-holes, dug into a street and opening through an upper, circular collar, while the expression circular cover includes the circular grates of the gully-holes.

BACKGROUND OF THE INVENTION

A conventional manhole bored in a street opens through a top circular collar surrounded by concrete, which collar receives a circular cover closing the manhole and having a top surface that should be at the same level as the surface of the street. When a street, after years of wear, has to be repaved, e.g. with asphalt, the cover must be raise d to remain at the level of the street surface. Conventionally, this operation is carried out by digging, breaking the concrete around the manhole collar, and pouring concrete on the new foundation around the upwardly-offset collar. Of course, such an operation is tedious and time-consuming, and requires at least four workers as well as a heavy, pneumatic equipment. This conventional method of raising the cover level of a street manhole is therefore expensive.

In applicant's co-pending Canadian Patent application No. 5873,231 filed July 28, 1988, there is disclosed a ring1ike device for raising a circular, peripherally-notched cover of a street manhoie opening through an upper, circular collar peripherally surrounding the cover and supporting the same, which collar having a geometrical axis and comprising at least one inner projection fitting in one peripheral notch of the cover to prevent rotation of the latter about the above geometrical axis; this ringlike device comprises: a lower circular ring (a) with a top surface, (b) having a first diameter so dimensioned that the lower ring fits in the manhole collar, and (c) being bent to define at least one peripheral, outer notch so designed that said at least one inner projection of the collar fits therein; an upper, circular ring (a) with a top surface, (b) having a second diameter greater than the first one and so dimensioned that the cover fits within the upper ring, and (c) being provided with at least one inner projection fitting in the notch of the cover; and means for assembling together the circular rings, with the lower and upper rings coaxial to each other and with the top surface of the upper ring higher than the top surface of the lower ring; whereby, (a) the lower ring can be disposed in the collar after the cover has been removed therefrom, with said at least one projection of the collar fitted in said at least one notch of the lower ring to prevent rotation of the ringlike device about the geometrical axis of the collar and with the collar peripherally surrounding the lower ring and supporting the same, (b) the cover can be disposed on the top surface of the lower ring with said at least one projection of the upper ring fitted in said notch of the cover to prevent rotation of the cover about the geometrical axis of the collar and with the upper ring peripherally surrounding the said manhole cover, and (c) the street can be covered with an additional layer of pavement of a thickness corresponding to the height of the top surface of the upper ring above an already existing pavement, which additional layer of pavement surrounding and compressing the upper ring to hold firmly in position the ringlike, cover raising device.

However, in this co-pending Canadian Patent application, the tongues in such a device, since they are parallel to the through-axis of the circular rings, or the weld joints thereof about the circular ring, will break when the spacing adjustment between the circular rings is made under a substantial load being applied in the said direction of through axes of the circular rings. This thus renders inoperative a good number of ring-like members.

OBJECTS OF THE INVENTION

The gist of the invention is therefore to provide adjustment means for a spacer member for raising the cover of a street manhole, following a street repavement, these adjustment means enabling some measure of adjustment in the value of the total height by which the cover is to be raised.

A general object of the present invention is to provide means for substantially reducing the efforts and expenses involved in the new street levelling manhole cover pursuant to the repaving of the street.

SUMMARY OF THE INVENTION

In accordance with the invention, there is provided, in a street manhole defining an elongated manhole duct provided with a rigid collar member at its top mouth, said collar member havin a radially inward annular cavity defining a base wall, parallel to the plane of said collar member, a side wall, orthogonal to the base wall, and a top wall parallel to said base wall; wherein a spacer member is provided for raising said cover from said collar base wall, said spacer member defining: (a) a first rigid annular member, destined to sit on said collar base wall; (b) a second rigid annular member, diametrally larger than said first annular member and destined to sit on said collar top wall; and (c) connecting means, for coaxially interconnecting said annular members about spaced planes, said connecting means further including adjustment means to bring said first annular member to sit against said collar base wall and said second annular member to sit against said collar top wall, said adjustment means being responsive to a biasing load being applied transversely to at least one of said cover member and said second annular member.

Using the ringlike device of the invention, only one worker and light equipment is required to raise the cover of a street manhole. Moreover, no digging, no breaking of the concrete around the manhole cover, no new packed foundation, and no pouring of concrete is required to carry out such an operation.

DETAILED DESCRIPTION OF THE INVENTION

Figure 1:
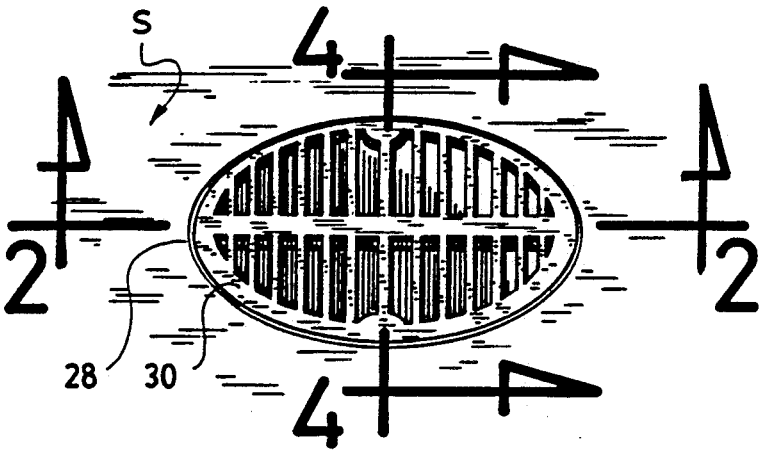
FIG. 1 is a top perspective view of a manhole cover.
Figure 2:
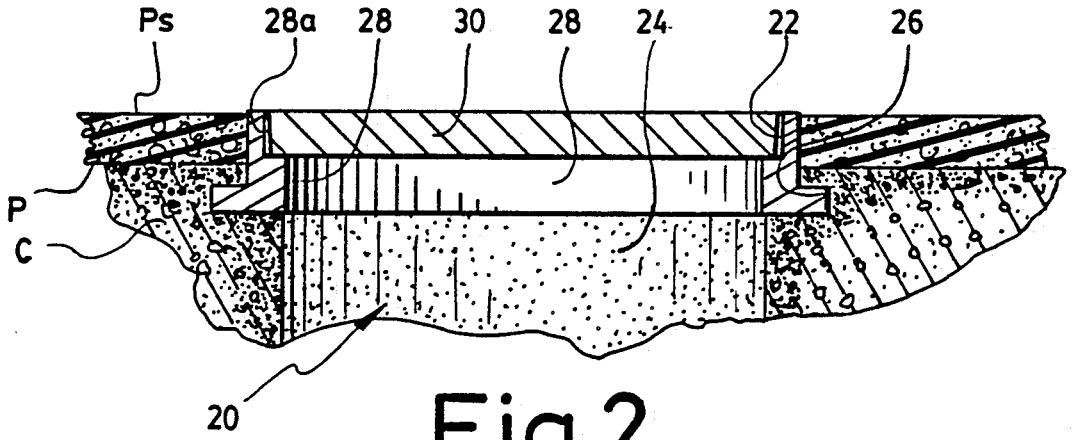
FIG. 2 is an enlarged sectional view along lines 2—2 of FIG. 1.

As illustrated in FIGS. 1-4, a street manhole 20 conventionally consists of a hole 22, made into the pavement P of a street S and through which a man can enter an underground vertical duct 24, made in the concrete C and earth (not shown supporting the pavement P, the duct leading to an artificial underground horizontal canal (not shown), e.g. a sewer carrying drainage water and other waste materials, for cleaning or repairing purposes. Concrete C includes a radially outward annular cavity 26 about the top end section of duct 24, for receiving, supporting and anchoring thereabout a rigid collar member 28 which extends through pavement hole 22 up to a level substantially coplanar to the free top surface Ps of Pavement P. Collar member 28 includes a thicknesswisely radially inward annular cavity 28*a* for receiving and edgewisely supporting a cover 30. Cover 30 usually consists either of a metallic grate plate (FIG. 1) of substantially circular shape, or of a full circular plate 30' (FIG. 12), depending its purpose and upon the type of manhole involved. Cover 30 is freely removable from its supporting collar member cavity 28*a*, simply by pulling it upwardly therefrom. When installed in cavity 28*a*, cover 30 edgewisely contacts radially outer vertical wall 28*c* of cavity 28*a*.

Figure 3:
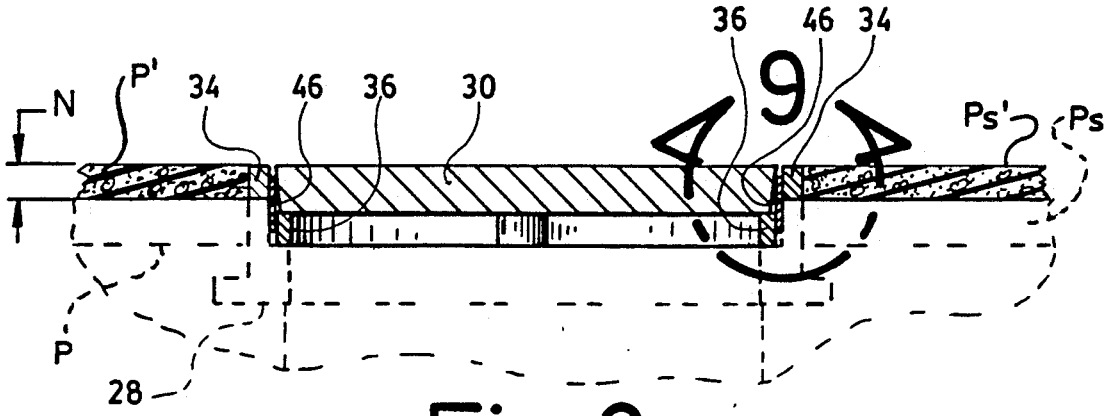
FIG. 3 is a view similar to that of FIG. 2, but about a plane inclined relative to that of lines 2—2, and further including an annular spacer member for manhole cover provided an accordance with the invention and shown in cross-section.
Figure 4:
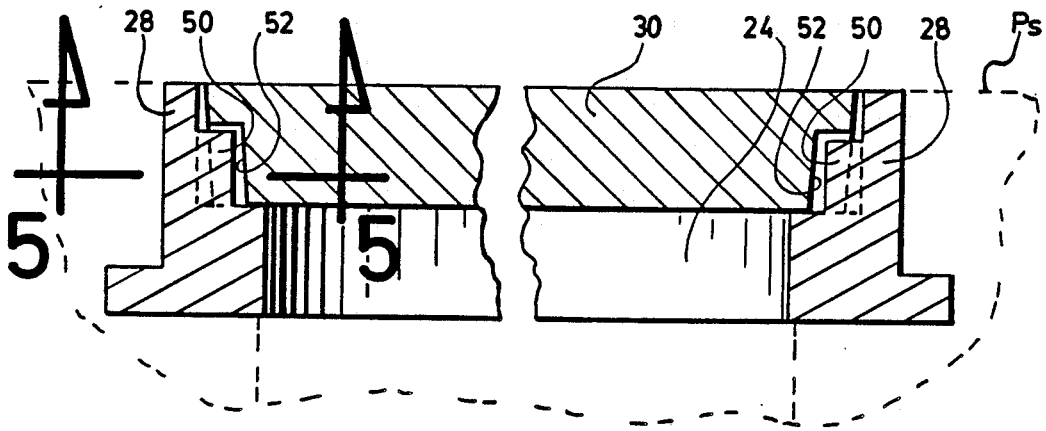
FIG. 4 is a cross-sectional view at a still larger scale along lines 4—4 of FIG. 1.
Figure 6:
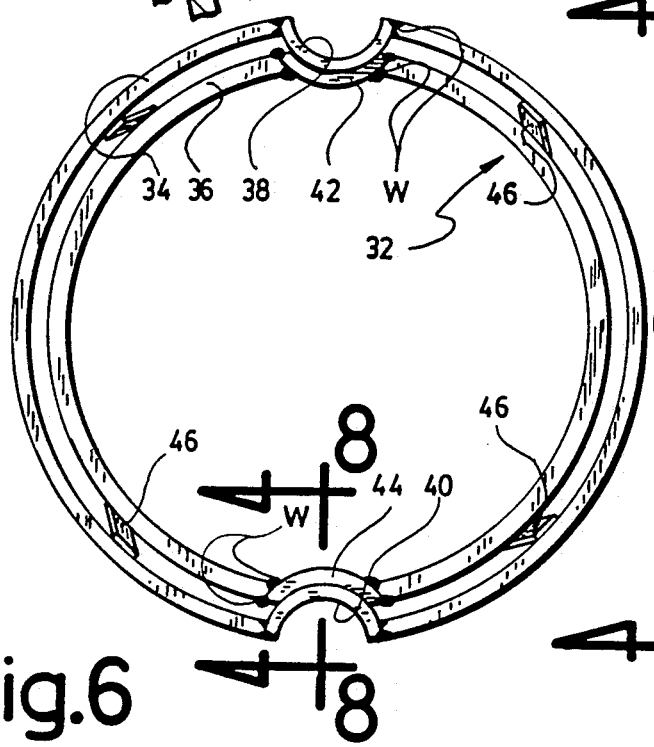
FIG. 6 is a plan view at an enlarges scale, of the annular cover support forming part of the preferred embodiment of manhole cover assembly of the invention.
Figure 7:
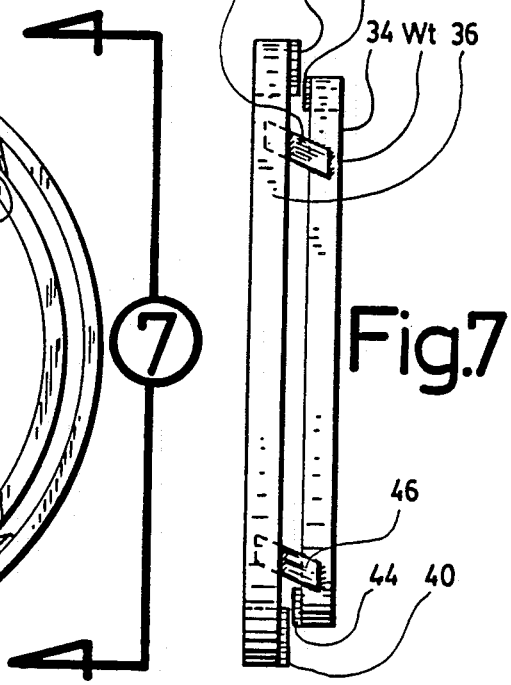
FIG. 7 is an édge of the annular cover of FIG. 6.
Figure 8:
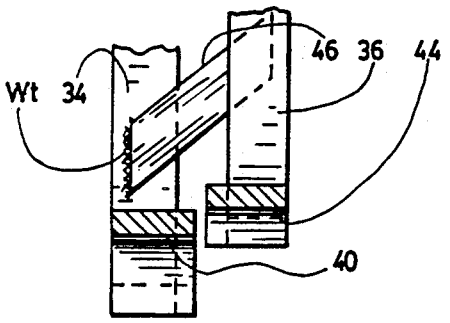
FIG. 8 is a cross-sectional view, at an enlarged scale, along lines 8—8 of FIG. 6.

As illustrated in FIGS. 3 and 6-7 of the drawings, the annular spacer member of the invention, identified as 32, is to be positioned into the collar member annular cavity 28*a*, and is to edgewisely support cover 30 which is therefore upwardly offset from its former position. The ringlike device 32 includes two interconnected, substantially parallel rings. Hence, device (or spacer member) 32 of the invention comprises an upper circular ring 34 and a lower circular ring 36. Moreover, the top free face of the upper ring 34 is destined to substantially horizontally register with the outer free face P's of a newly laid layer of pavement P', of thickness N, laid over the initial, worn out pavement P, see FIG. 3. The rings 34, 36 are made from a rigid material, preferably from steel bar of rectangular cross-section, this bar being able to bend under a forcible biasing load. In order to form the ring 34, the corresponding steel bar is bent to become circular and the two ends thereof are welded together, while to form the ring 36, the corresponding steel bar is also bent to become circular and the two ends thereof are also welded together.

Figure 5:
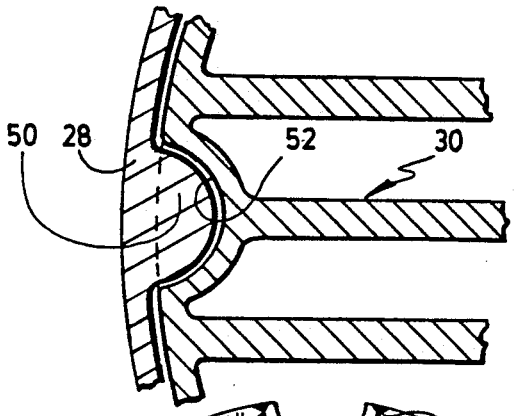
FIG. 5 is a cross-sectional view taken along lines 5—5 of FIG. 4.

Upper ring 34 defines a radius of curvature greater than lower ring 36 with the upper ring radially inner face being radially outwardly spaced from the lower ring radially outer face (FIG. 6.) The rings 34, 36 may be further bent to define two diametrically opposed pairs of peripheral, outer notches 38, 40 and 42, 44, which are anchored in place by welding W and which are preferably semi-circular. Notches 38-44 are required only when the cover plate 30 is used as a through plate or grille, for through passage of water at the mouth of a drain, whereby it is provided with lengthwise slots 30 (FIGS. 1 and 5). This is to take into account bicycles and other longitudinally aligned, two wheel vehicles, wherein the cover's slot must be maintained transverse to the rolling or lengthwise road direction to prevent a bicycle wheel from sinking into the drain, an obvious road safety hazard. Hence, when the cover is full, such notches 38-44 have no use whatsoever. In an event, such features were already introduced and disclosed in said applicant's copending Canadian Patent applicant No. 573,231.

The rings 34 and 36 are assembled together in coaxial and parallel fashion by means of a plurality of substantially rigid peripherally spaced, rectangular plates or tongues, 46. Each tongue 46 has its lower end welded to the radially outer surface ot the inner ring 36 and its upper end welded to the radially inner surface of the outer ring 34. The tongues 46 are preferably equidistant. Also, they are preferably arranged in pairs of diametrally-opposed tongues. The number of pairs of diametrically-opposed tongues should increase correspondingly with the overall diameter of the ringlike device 32 and/or with the load expected to be sustained by cover 30 or outer ring 34.

The heart of the invention lies in the orientation of each rectangular tongue 46 relative to rings 34 and 36. Indeed, outwardly, upwardly inclined, since it extends between the radially inner and outer rings, but, as illustrated in FIG. 6, it is also characterized by its two ends being tangentially shifted or offset by an acute angular value relative to a substantially vertical axis parall to the lengthwise axis of duct 24. This angular value may range between 30 to 60° , preferably between 40 to 50 degrees, and most preferably of about 45 degrees. Necessarily, each tongue 46 must be ottset toward the same side as the other tongues, i.e. either in clockwise or in counterclockwise direction. The angular value tangential offset of the tongues need not be exactly the same from one tongue to the other, but preferably they are substantially the same. The endwise welding points Wt of the tongues onto the rings should be firmly anchored so as to positively prevent any loosening thereof. However, the substantially rigid material constituting each tongue must boast some flexing or torsional capability, so as to be able to bend under forcible biasing force applied against the cover transversely to the plane thereof, toward said duct 24, and to retain this bent shape once said biasing force has been released, whereby the planes of said rings 34, 36 may be either brought closer together or else moved away from each other, without any breaking of the weld points Wt.

It can now be understood that such torsional capability of the tongues 46 will enable to adjustably vary the distance between the planes of rings 34 and 36, under a load being applied onto the cover 30, e.g. a truck rolling thereover. Indeed, as is suggested in FIGS. 9-11, such load-induced torsional bias on the tongues 46 would imply a reduction of the distance between the rings 34 and 36, since anchor points Wt are firm. Thus, a suitably large annular cavity 28*a* should be provided, for accommodating the torsional (thicknesswise) play of the tongues (relative to their plane).

Figure 9:
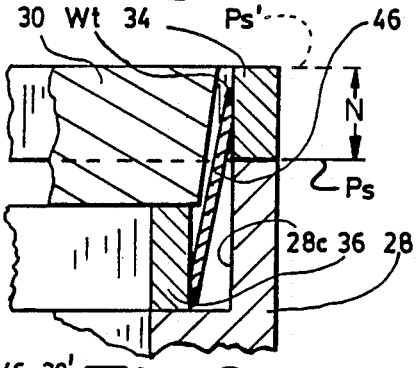

FIG. 9 shows a first possible outcome in which the to faces of cover 30 and ring 34 happen to be exactly coplanar to the pavement Ps as the bottom face of ring 36 sits flatly into the annular seat 28*b* of collar cavity 28*a*.

Figure 10:
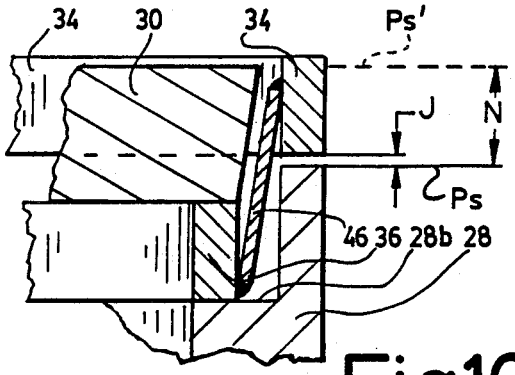
FIGS. 9-11 are enlarged views of the area circumscribed by circle 9 in FIG. 5, showing the relative play of the elements constituting the manhole cover assembly.

FIG. 10 shows a second outcome in which, as ring 36 rests onto the annular seat 28*b* of cavity 28*a*, ring 34 spacedly lays over collar 28 whereby the top surface of cover 30 is upwardly offset from the pavement surface Ps and is downwardly offset relative to the top surface of ring 34. When a vehicle will roll over assembly 30, 34, it will automatically induce by its weight the sinking of ring 34 so that its top face (and that of cover 30 will come to register with that of pavement P at Ps, thereby drawing toward each other rings 34 and 36.

Figure 11:
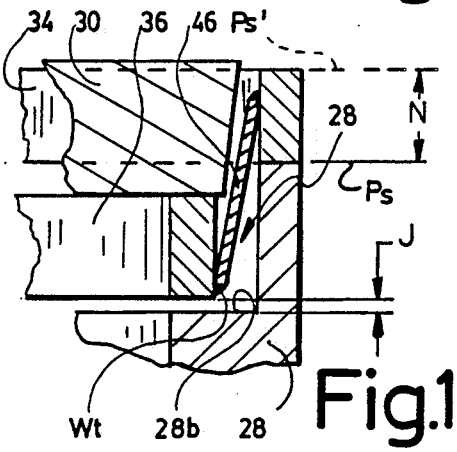

FIG. 11 shows a third outcome in which, as ring 34 rests flatly against the top edgewise face of collar 28, ring 36 hangs freely spacedly over the annular seat 28*b* of collar cavity 28*a* while cover 30 protrudes outwardly from the plane of the top faces of ring 34 and pavement Ps. Upon a vehicle rolling onto cover 30, ring 36 will sink thereby increasing the distance between rings 34 and 36.

The collar 28 conventionally comprises two diametrically-opposed inner projections 50 respectively fitting into the diametrically-opposed peripheral notches 52 of the cover 30. The cover 30 is thereby prevented from rotating about the geometrical axis of the collar 28.

When a road is to be repaved, the following procedure is to be followed: first of all, the cover 30 is removed from the manhole collar 28. The lower ring 36 is then installed in the collar 28 with the projections 50 of the collar fitted in the notches 42, 44 of the ring 36, whereby the ringlike device oannot rotate about the geometrical axis of the collar. The ring 36 is so dimensioned that it fits inside the cavity 28*a*, with the lower ends of the tongues interposed between this ring 36 and the radially outer wall 28*c* of the inner side of cavity 28*a*.

Last of all, the cover 30 is positioned on the top surface of the ring 36 with the inner projections 38, 40 of the ring 34 fitted in the notches 52 of the cover, respectively, to prevent rotation ot the cover about the geometrical axis of the collar 28. The ring 34 surrounds the cover 30 with the upper ends of the tongues 46 interposed between this ring 34 and the edge of cover 30.

As evidenced in FIGS. 9–11 and 13, the additional layer of pavement, e.g. of asphalt, is indicated as N.

Obviously, the ringlike device can be adjusted in diameter and other dimensions in accordance with the diameter and other dimensions ot the manhole collar and cover, and also in accordance with the desired thickness of the added layer of pavement.

Figure 12:
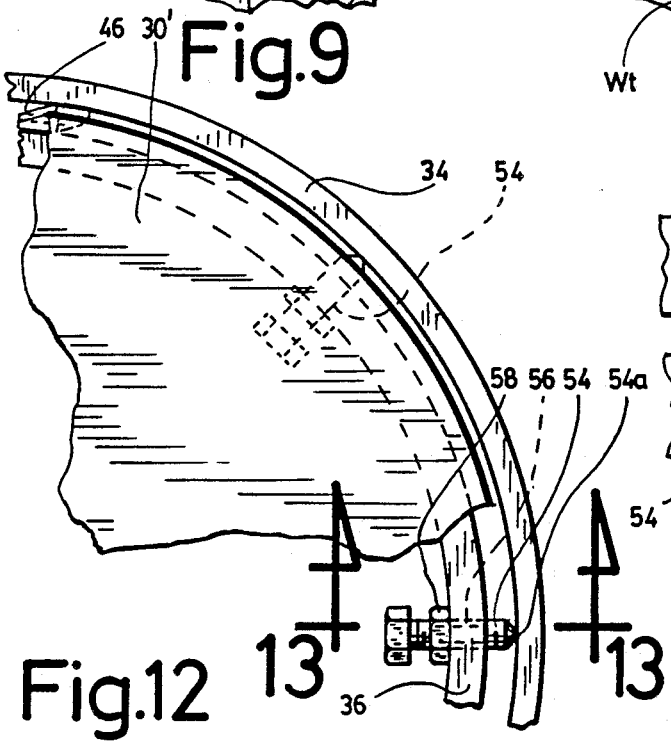
FIG. 12 is an enlarged, broken, plan view of a sector of the manhole cover assembly, showing an alternate embodiment of the invention.
Figure 13:
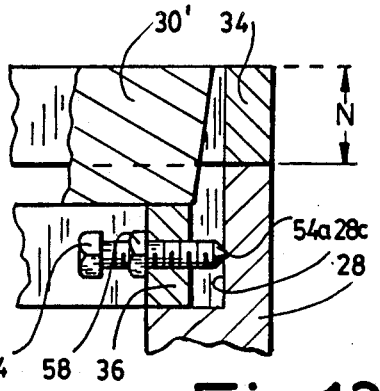
FIG. 13 is a cross-sectional view taken along line 13—13 of FIG. 12.

FIGS. 12–13 show an alternate embodiment of tongue means, for interconnecting the rings 34 and 36. The plate tongues are replaced by corresponding numbers of bolts 54 each extending through a threaded bore 56 made thicknesswisely of ring 36 in its radial plane. The bolt tiP 54*a* can therefore adjustably frictionally abut against the radially inner face of the collar member. Preferably, a lock or check nut 58 is added to bolt 54 on the radially inner side of ring 36, to prevent rotation of bolt 54 so as to block same in position once the desired spacing between ring 36 and collar wall 28*c* in cavity 28*a* is established, i.e. once the appropriate planar distance between rings 34 and 36 has been adjusted under a load bias applied onto full cover 30'or upper ring 34.

It should be understood that, although it is believed preferably that the relative displacement of rings 34, 36 should always be such as to maintain their plane positively parallel to each other, it is envisioned that in special circumstances, the load-induced displacement of rings 34, 36 could provide for a final non-parallel relative positioning thereof.

It will also be understood that the inclination of the plate tongues 46 relative to a vertical axis passing therethrough is paramount, otherwise, if they are vertical, then there can be no relative displacement of the rings either away from each other or toward each other. In fact, such a displacement would necessarily mean the breaking of the welding joints of these vertical tongues to the rings, which would mean that the spacer member would become completely inoperative.

Of course, tongues 46 need not be rectangular and could be square-shaped, disc-shaped, or other shape, provided any such shape maintains tongues 46 sufficiently thin to enable flexing or bending thereof under said forcible load.

I claim:

1. In a street manhole defining an elongated manhole duct provided with a rigid collar member at its top mouth, said collar member having a radially inward annular cavity defining a base wall, parallel to the plane of said collar member and a side wall, orthogonal to the base wall, said collar member further defining a top wall parallel to said base wall; wherein a spacer member is provided for raising said cover from said collar base wall, said spacer member defining:

(a) a first rigid annular member, destined to sit on said collar base wall;

(b) a second rigid annular member, diametrally larger than said first annular member and destined to sit on said collar top wall; and (c) connecting means, for coaxially interconnecting said annular members about spaced planes, said connecting means further including adjustment means to bring said first annular member to sit against said collar base wall and said second annular member to sit against said collar top wall, said adjustment means being responsive to a biasing load being applied transversely to the plane of at least one of said cover member and said second annular member.

2. A manhole cover spacer member as defined in claim 1, wherein said first smaller annular member defines a first, flat, radially outer wall spaced radially inwardly from the level of a second, flat, radially inner wall defined by said second larger annular member; said connecting means consisting of at least a few substantially rigid, thin, tongue plates each interconnecting a section of said first outer wall to a section of said second inner wall, and fixedly secured thereto by permanent anchoring means, each said plate being not only radially outwardly upwardly inclined but also its lower and upper ends are tangentially offset i.e. radially out of register from each other by an acute angular value defined with respect to an axis parallel to the lengthwise axis of said manhole duct; said tongue plates being made from a material capable of yieldingly torsionally flexing when said biasing load is applied for displacement of said annular members relative to each other..

3. A manhole cover spacer member as defined in claim 2, wherein said tongue plates are equidistant.

4. A manhole cover spacer member as defined in claim 3, wherein said plates are equidistant in radially opposite pairs, whereby the plane of said annular members always remain parallel to each other when displaced under said biasing load.

5. A manhole cover spacer member as defined in claim 2, wherein said tongue plate angular value ranges between 30 and 60 degrees.

6. A manhole cover spacer member as defined in claim 5, wherein said tongue plate angular value ranges between 30 and 40 degrees.

7. A manhole cover spacer member as defined in claim 1, further including a number of bolt members, threadedly radially engaged through said second diametrally smaller annular member for frictionally radially abutting against said collar member, for frictionally lockingly immobilizing said smalled annular member in position.

8. A manhole cover spacer member as defined in claim 5, wherein said tongue angular value with respect to the axis parallel to said duct is identical for all of said tongues.

9. A manhole cover spacer member as defined in claim 7, further including a lock nut member, mounted about each bolt member.

* * * * *